US007165766B2

(12) United States Patent
Sato

(10) Patent No.: US 7,165,766 B2
(45) Date of Patent: Jan. 23, 2007

(54) SHEET FEEDING CASSETTE AND IMAGE FORMING APPARATUS

(75) Inventor: Shougo Sato, Seto (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 183 days.

(21) Appl. No.: 10/963,663

(22) Filed: Oct. 14, 2004

(65) Prior Publication Data

US 2005/0082743 A1 Apr. 21, 2005

(30) Foreign Application Priority Data

Oct. 17, 2003 (JP) ..... 2003-358347

(51) Int. Cl.
*B65H 1/00* (2006.01)

(52) U.S. Cl. ..... 271/145; 271/147

(58) Field of Classification Search ..... 271/145, 271/147, 162, 163, 164, 171; 399/377, 393; 347/104

See application file for complete search history.

(56) References Cited

U.S. PATENT DOCUMENTS

| | | | | |
|---|---|---|---|---|
| 4,609,281 | A * | 9/1986 | Miyai et al. | 399/108 |
| 4,635,010 | A * | 1/1987 | Miyai et al. | 399/108 |
| 4,789,876 | A * | 12/1988 | Miyai et al. | 399/108 |
| 5,401,014 | A * | 3/1995 | Okabe et al. | 271/255 |
| 5,564,690 | A * | 10/1996 | Oshida | 271/157 |
| 5,884,136 | A * | 3/1999 | Takei et al. | 399/393 |
| 5,908,189 | A * | 6/1999 | Flores et al. | 271/164 |
| 5,918,875 | A * | 7/1999 | Masley et al. | 271/162 |
| 6,049,346 | A * | 4/2000 | Cho | 347/153 |
| 6,308,025 | B1 * | 10/2001 | Okano et al. | 399/107 |
| 6,364,309 | B1 * | 4/2002 | Tomatsu | 271/160 |
| 6,422,772 | B1 * | 7/2002 | Fisher et al. | 400/629 |
| 6,634,638 | B2 * | 10/2003 | Toda et al. | 271/162 |
| 6,722,648 | B2 * | 4/2004 | Tsusaka et al. | 271/65 |
| 6,834,172 | B2 * | 12/2004 | Tomita | 399/108 |
| 6,851,670 | B2 * | 2/2005 | Todd | 271/145 |
| 6,902,270 | B2 * | 6/2005 | Unosawa | 347/108 |
| 2003/0132080 | A1 * | 7/2003 | Dababneh | 190/115 |

FOREIGN PATENT DOCUMENTS

| | | | | |
|---|---|---|---|---|
| JP | 60-170866 | | 9/1985 | |
| JP | 01098531 | A * | 4/1989 | 271/162 |
| JP | 04272035 | A * | 9/1992 | 271/162 |
| JP | 5-116772 | | 5/1993 | |
| JP | 2001-63833 | | 3/2001 | |
| JP | 3379992 | | 12/2002 | |

* cited by examiner

*Primary Examiner*—Patrick Mackey
*Assistant Examiner*—Jeremy R Severson
(74) *Attorney, Agent, or Firm*—Oliff & Berridge, PLC

(57) ABSTRACT

A sheet feeding cassette is configured so as to be able to be attached to and removed from an image forming apparatus main body having an image forming section and is equipped with a box-shaped accommodation portion capable of accommodating a plurality of sheets. A grip to be used for holding the sheet feeding cassette with a hand is provided close to the front surface of the sheet feeding cassette so as to be located above a sheet placement surface on which sheets are to be placed in the accommodation portion. An angle formed by the sheet placement surface and a straight line passing through the grip and the center of gravity of the sheet feeding cassette is larger than or equal to 5°.

13 Claims, 12 Drawing Sheets

SHEET FEEDING CASSETTE AND IMAGE FORMING APPARATUS

BACKGROUND OF THE INVENTION

1. Field of the Invention

The present invention relates to a sheet feeding cassette and an image forming apparatus.

2. Description of the Related Art

For example, printers are provided conventionally as image forming apparatus. A printer has a general configuration that a main body incorporates a process unit, a fixing section, a scanner, etc., and a sheet feeding cassette capable of accommodating sheets as recording media is disposed detachably in a bottom portion of the main body. In this configuration, sheets accommodated in the sheet feeding cassette are supplied to an image forming section in the main body by a sheet feed roller and other rollers and are subjected to printing there.

SUMMARY OF THE INVENTION

Incidentally, with the recent increase in printing speed (i.e., increase in the number of sheets used per unit time), the number of sheets that can be accommodated in the sheet feeding cassette is showing a tendency to increase. With such sheet feeding cassettes capable of accommodating a large number of sheets, it is a general procedure to separate the sheet feeding cassette completely from the printer, replenish it with sheets, and then attach the sheet feeding cassette to the printer. In removing or attaching the sheet feeding cassette from or to the printer, it is necessary to handle the sheet feeding cassette so that sheets do not fall out of it. However, in general, sheet feeding cassettes are configured so as to have a grip in a front portion (on a user's side). If a user held the grip and removed the sheet feeding cassette completely, the sheet feeding cassette would usually hang on the hand that holds the grip, as a result of which sheets would fall out of the sheet feeding cassette. To prevent such an event, for example, the user is required to handle the sheet feeding cassette with both hands.

Japanese Patent No. 3,379,992 discloses a sheet feeding cassette that is configured so as to solve the above problem; that is, the sheet feeding cassette is equipped with a medium pressing mechanism that enables a manual operation for pressing sheets. In this technique, when the sheet feeding cassette is removed from the main body of the image forming apparatus, medium (i.e., sheets) are pressed by the medium pressing mechanism so that the sheets are held within the sheet feeding cassette and prevented from falling out of it. However, the provision of the medium pressing mechanism results in problems that the configuration is complicated and the number of components is increased. Further, a user is forced to manipulate the mechanism.

The present invention has been made in view of the above circumstances, and an object of the invention is to provide a configuration capable of effectively preventing sheets accommodated in a sheet feeding cassette from falling out of it when the sheet feeding cassette is removed from the main body of an image forming apparatus.

According to one aspect of the invention, there is provided a sheet feeding cassette including: a box-shaped accommodation portion capable of accommodating a sheet, the accommodation portion having a sheet placement surface on which the sheet is to be placed; and a grip to be used for holding the sheet feeding cassette with a hand, the grip being provided to a front surface side of the sheet feeding cassette so as to be located above the sheet placement surface; wherein an angle formed by the sheet placement surface and a straight line passing through the grip and a center of gravity of the sheet feeding cassette is larger than or equal to 5°.

In this configuration, the angle formed by the sheet placement surface and the straight line passing through the grip and the center of gravity of the sheet feeding cassette is larger than or equal to 5°. Therefore, when the sheet feeding cassette is hung by holding the grip, the sheets are held in the sheet feeding cassette in a state that the sheet feeding cassette is inclined to such an extent that the sheets are not prone to fall. Falling of the sheets can thus be prevented effectively.

In the case where the sheet placement surface is a single flat surface, the sheet feeding cassette can be configured in such a manner that the angle formed by the single surface and the above-mentioned straight line is larger than or equal to 5°. Where the sheet placement surface consists of a plurality of surfaces (e.g., sheets are placed on a plurality of surfaces that form a bent surface (see FIG. 12; described later)), the intended effect is obtained as long as the angle formed by the straight line and at least one of those surfaces is larger than or equal to 5° (the angle formed by the straight line and any of those surfaces should be larger than or equal to 0°). However, it is desirable that the angle formed by the straight line and any of those surfaces be larger than or equal to 5°.

BRIEF DESCRIPTION OF THE DRAWINGS

The present invention may be more readily described with reference to the accompanying drawings.

DETAILED DESCRIPTION OF THE PREFERRED EMBODIMENTS

Figure 1:
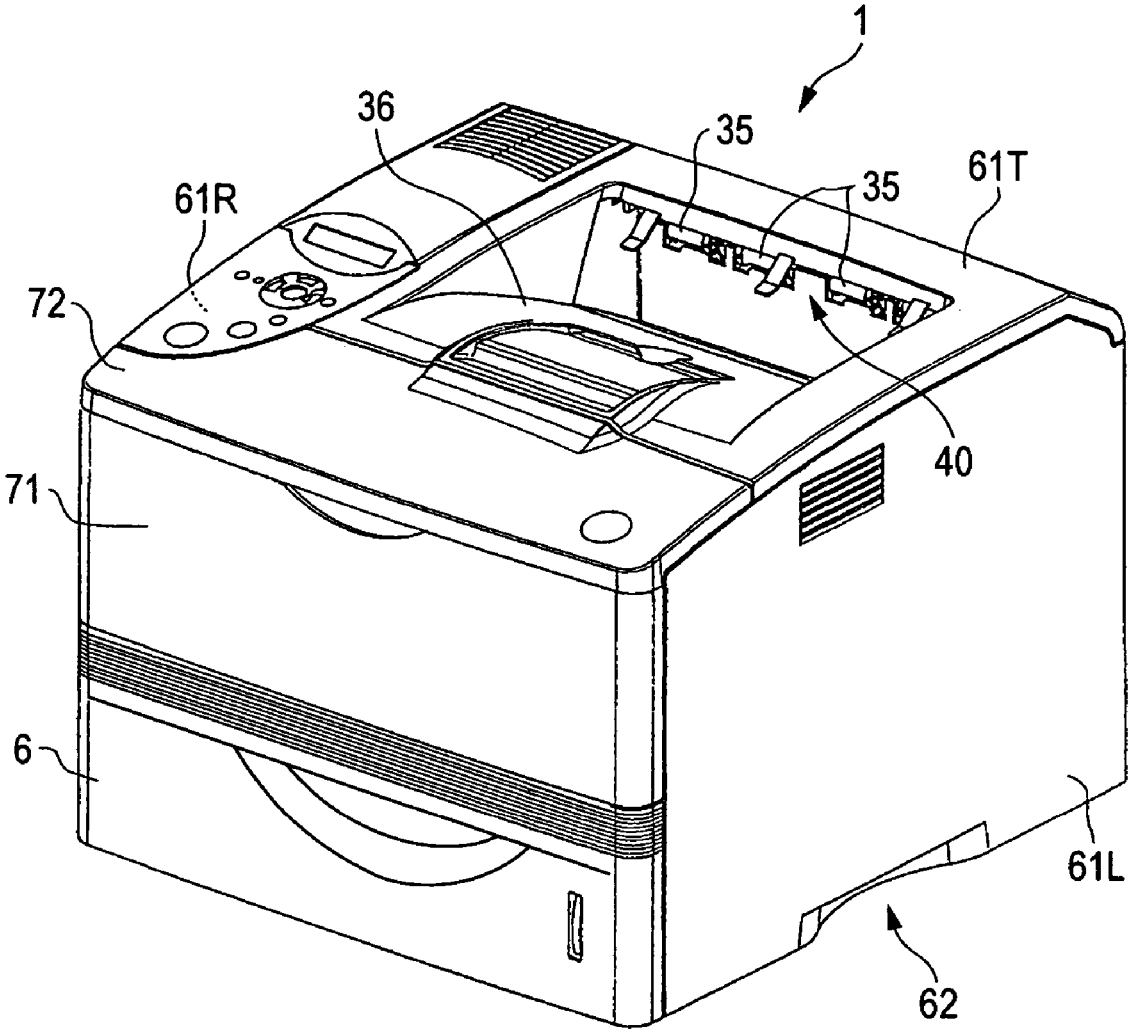
FIG. 1 is a perspective view showing the entire configuration of a laser printer according to an embodiment of the present invention.
Figure 2:
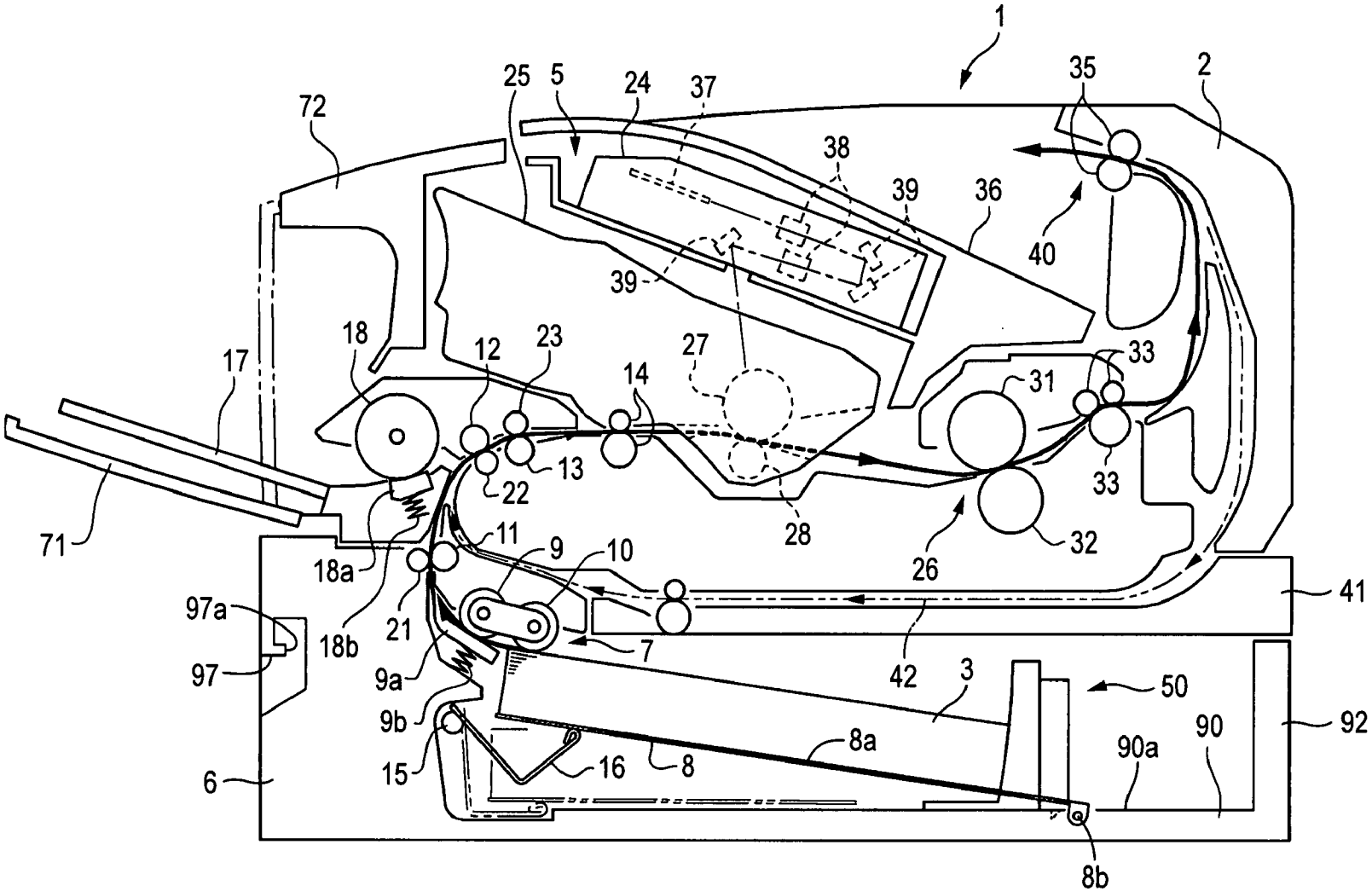
FIG. 2 is a schematic side sectional view of the laser printer.

Next, an image forming apparatus according to an embodiment of the present invention will be described with reference to the drawings. First, the entire configuration of a laser printer 1 will be described with reference to FIGS. 1 and 2. FIG. 1 is a perspective view showing the entire configuration of a laser printer 1 according to the embodiment of the invention. FIG. 2 is a side sectional view of the same.

The laser printer 1 of FIGS. 1 and 2 is an electrophotographic laser printer capable of double-sided printing. As shown in FIG. 2, the laser printer 1 is equipped with a separating and feeding section 7 for feeding a sheet 3 as a recording medium, an image forming section 5 as an image forming means for forming a prescribed image on the sheet 3 thus fed, and other sections and components.

In the following description, the upstream side and the downstream side in the sheet transport direction may be referred to simply as "upstream side" and "downstream side," respectively. And a positional relationship of members may be described by referring to the bottom-left side in FIG. 1 (i.e., the left side in FIG. 2) as the front side of the apparatus.

As shown in FIG. 2, an open-top, box-shaped sheet feeding cassette 6 is attached to an image forming apparatus main body 2 so as to occupy its bottom space. The separating and feeding section 7 is provided on the main body 2 side so as to be positioned with respect to one end portion (i.e., front end portion) of the sheet feeding cassette 6. A sheet elevating plate 8 is provided inside the sheet feeding cassette 6, and sheets 3 can be stacked on the sheet elevating plate 8. The sheet elevating plate 8 is disposed so as to be located on the side opposite to the separating and feeding section 7 with stacked sheets 3 interposed in between.

Supported slidably by the main body 2 as described later, the sheet feeding cassette 6 can be manipulated in the following manner. When the sheet feeding cassette 6 is pulled out to the front side, the sheet elevating plate 8 is exposed to the outside. In this state, sheets 3 are set on the sheet elevating plate 8. The sheet feeding cassette 6 is then pushed from the front side, whereby the sheet feeding cassette 6 slides and is set in the printer main body 2. Further, the sheet feeding cassette 6 can be removed from the main body 2 by pulling out the sheet feeding cassette 6 by causing it to slide to the front side.

A first transport roller 11, a second transport roller 12, and a third transport roller 13 are disposed in this order downstream of the separating and feeding section 7. A pair of registration rollers 14 are disposed downstream of the third transport roller 13.

Sheet powder removing rollers 21–23 are disposed so as to be opposed to the first to third transport rollers 11–13, respectively. Being rollers whose surfaces tend to be charged (e.g., rollers made of a fluororesin or rollers having fluorine-coated surfaces), the sheet powder removing rollers 21–23 remove sheet powder that is stuck to a sheet 3 by electrostatic absorption and thereby prevent a phenomenon that sheet power is mixed into toner used in the image forming section 5 (described later) and deteriorates the image quality.

The separating and feeding section 7 is equipped with a pickup roller 10, a feed roller 9 that is disposed downstream of the pickup roller 10, and a separating pad 9*a* that is opposed to the feed roller 9. The pickup roller 10 and the feed roller 9 are disposed on the main body 2 side and the separating pad 9*a* is disposed on the sheet feeding cassette 6 side. Equipped with an urging spring 9*b*, the separating pad 9*a* is pressed against the feed roller 9 by the elastic force of the urging spring 9*b*.

As shown in FIG. 2, the sheet elevating plate 8 enables stacking of sheets 3. The end portion (rear end portion) of the sheet elevating plate 8 that is far from the feed roller 9 is supported pivotably, whereby the other end portion (front end portion) that is close to the feed roller 9 can be moved in the vertical direction.

A rotary shaft 15 is supported by the sheet feeding cassette 6 under the feed roller 9. An L-shaped press-operating member 16 is fixed to the rotary shaft 15, and the tip of the press-operating member 16 is inserted in a space defined under the sheet elevating plate 8. The rotary shaft 15 can be driven by an elevating plate driving unit (described later; indicated by reference numeral 68 in FIGS. 3 and 4) that is composed of an electric motor, a reduction gear train, etc. When the rotary shaft 15 is driven by the elevating plate driving unit 68, the press-operating member 16 shown in FIG. 2 pushes up the bottom surface of the sheet elevating plate 8, whereby the sheet elevating plate 8 is rotated upward with its end portion (rear end portion) that is far from the separating and feeding section 7 serving as a supporting point. As a result, the sheet elevating plate 8 is moved toward the separating and feeding section 7.

Figure 3:
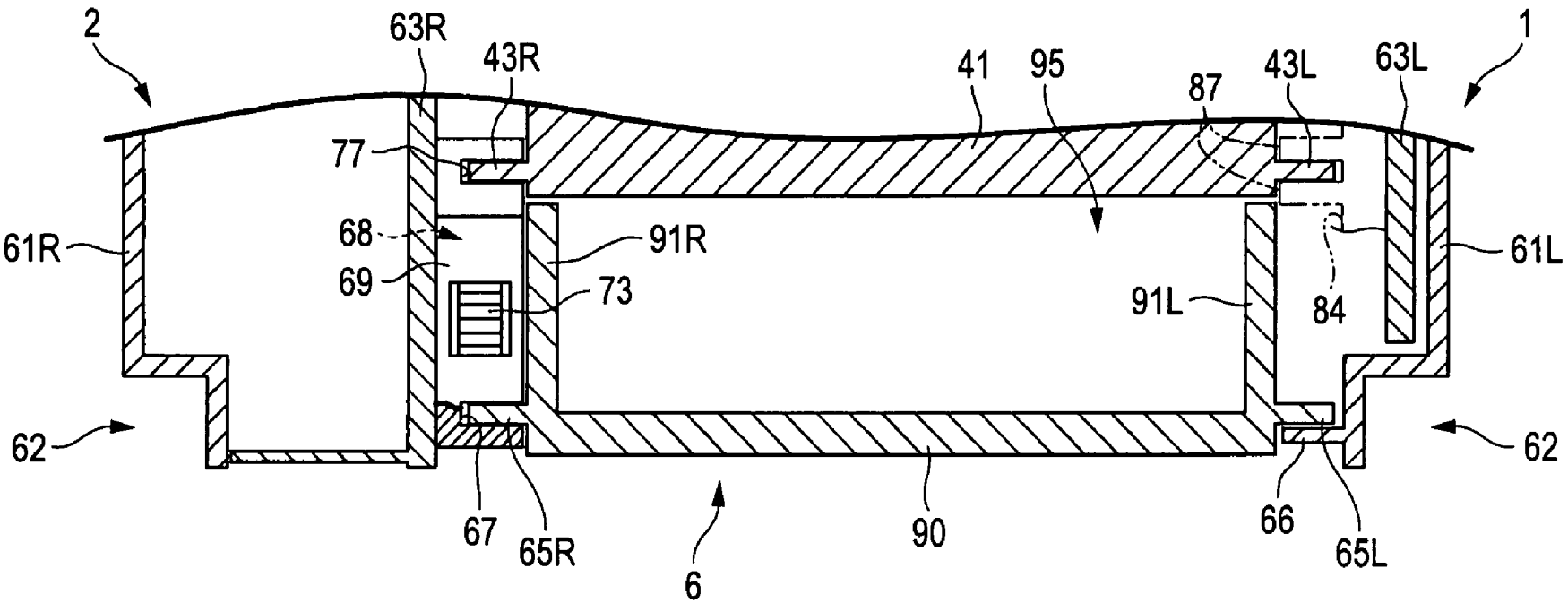
FIG. 3 is a front sectional view of part of the laser printer.
Figure 4:
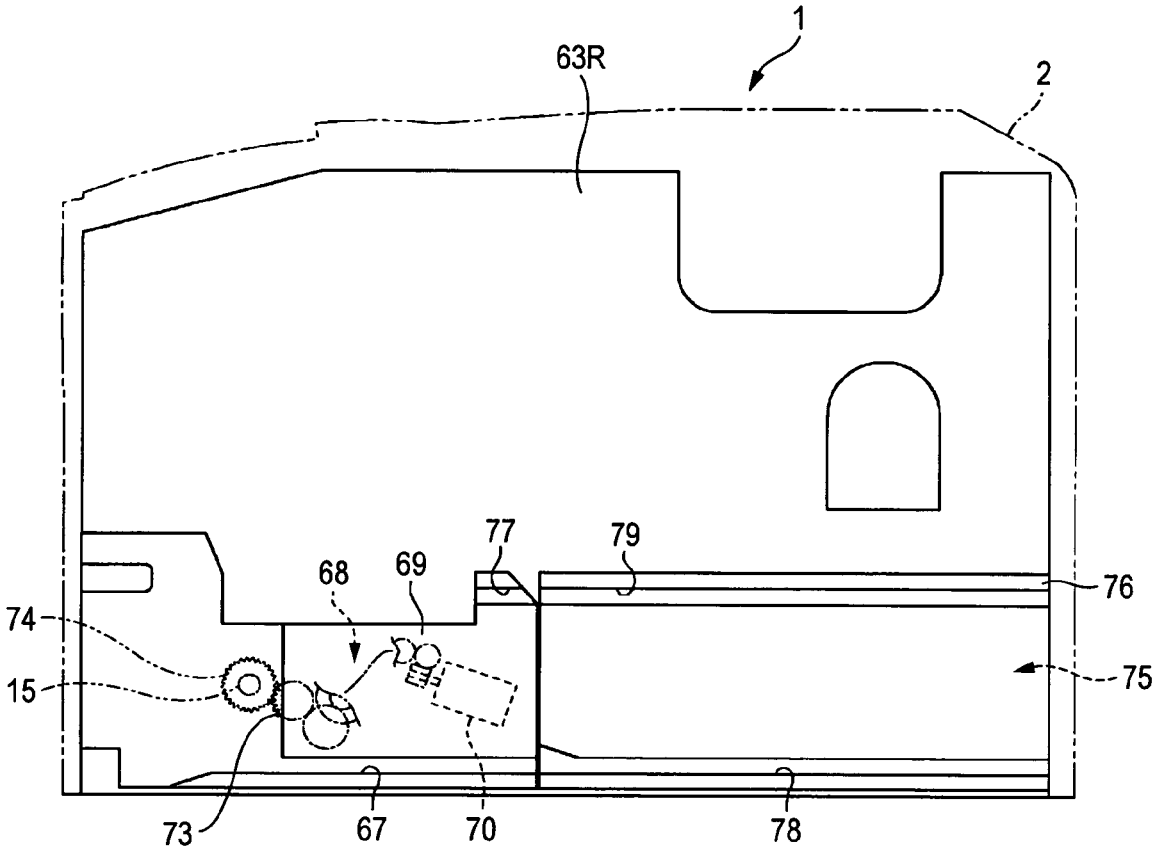
FIG. 4 is a view, as viewed from inside the apparatus, of an elevating plate driving unit and a main motor unit.

As shown in FIG. 2, the sheets 3 stacked on the sheet elevating plate 8 are pressed against the pickup roller 10 as the sheet elevating plate 8 is driven upward by the elevating plate driving unit 68 (see FIGS. 3 and 4). As the pickup roller 10 is driven, the top sheet 3 is fed to the feed roller 9 and inserted between the separating pad 9*a* and the feed roller 9. Sheets 5 are fed being separated from each other, that is, one by one, as the above members cooperate with each other.

The sheet 3 thus fed by the separating and feeding section 7 is sent to the registration rollers 14 by the first to third transport rollers 11–13. The registration rollers 14, which are a pair of rollers, performs a prescribed registration operation on the sheet 3 and then sends it to the image forming section 5.

As shown in FIG. 2, a multi-purpose tray 17 that enables stacking of sheets 3 having an arbitrary size is provided on the front side of the laser printer 1 so as to be able to be opened and closed. In the following description, the term "multi-purpose" will be abbreviated as "MP." An MP sheet feed roller 18 for feeding sheets 3 stacked on the MP tray 17 is disposed in the vicinity of the MP tray 17. An MP separating pad 18*a*, which is opposed to the MP sheet feed roller 18, is pressed against the MP sheet feed roller 18 by an urging spring 18*b*.

A first lid 71 is rotatably attached to the front portion of the apparatus. When the MP tray 17 is not used, the MP tray 17 and the first lid 71 are closed to provide the appearance of FIG. 1, thereby giving persons an impression that the front portion of the apparatus is trim as well as making it possible to protect such inside members as the MP sheet feed roller 18 and the MP separating pad 18*a*.

With the above structure, sheets (not shown) placed on the MP tray 17 shown in FIG. 2 are inserted between the MP sheet feed roller 18 and the MP separating pad 18*a* and then fed being separated from each other, that is, one by one, as these members cooperate with each other. The sheet thus fed is sent to the registration rollers 14 by the second and third transport rollers 12 and 13.

Next, the image forming section 5 will be described. The image forming section 5 is equipped with a scanner section 24, a process cartridge 25, a fixing section 26, etc. The scanner section 24, which occupies a top portion of the main body 2, is equipped with a laser light emitting section, a polygon mirror 37 that is driven rotationally, lenses 38, reflectors 39, etc. A laser beam that is based on prescribed image data and emitted from the light emitting section (not shown) passes through or is reflected by the members in the scanner section 24 as indicated by a chain line in FIG. 2 and then shines on the surface of a photosensitive drum 27 of the process cartridge 25 (described later) to scan that surface at high speed.

The process cartridge 25 is disposed under the scanner section 24 and is attached to the main body 2 in a detachable manner. The process cartridge 25 is equipped with the photosensitive drum 27 and a transfer roller 28 that is opposed to the photosensitive drum 27 as well as a scorotron charger, a toner accommodation portion, a development roller as a developing means, a layer thickness restricting blade, a toner supply roller, etc. (not shown). A second lid 72 is disposed rotatably on the top-front side of the main body 2. The process cartridge 25 can be attached to or removed from the main body 2 by opening the second lid 72.

The toner accommodation portion is charged with a positively chargeable, non-magnetic, single-component, polymeric toner as a developer. A thin layer of toner having a constant thickness is carried by a developing roller (not shown). On the other hand, the photosensitive drum 27 is disposed rotatably so as to be opposed to the developing roller. The drum main body is grounded and its surface is formed by a positively chargeable photosensitive layer that is made of polycarbonate or the like.

As the photosensitive drum 27 is rotated, the surface of the photosensitive drum 27 is charged positively and uniformly by the scorotron charger and then scanned at high speed with and exposed to a laser beam that comes from the scanner section 24, whereby an electrostatic latent image based on prescribed image data is formed on the photosensitive drum 27. Then, when the photosensitive drum 27 is opposed to the developing roller, positively charged toner that is carried by the developing roller is supplied to the electrostatic latent image (i.e., portions that have been exposed to the laser beam and decreased in potential of the surface of the photosensitive drum 27 that was once charged positively and uniformly) that is formed on the surface of the photosensitive drum 27, and comes to be carried selectively by the photosensitive drum 27. The electrostatic latent image is thereby visualized, that is, reversal development is performed.

The transfer roller 28 is opposed to the photosensitive drum 27 from below and is supported rotatably by the process cartridge 25. The image formed by the toner (i.e., toner image) that is carried by the photosensitive drum 27 is transferred to a sheet 3 as it passes between the photosensitive drum 27 and the transfer roller 28. The sheet 3 to which the toner image has been transferred is transported to the fixing section 26 (described below).

The fixing section 26 is equipped with a heat roller 31 that is disposed downstream of the process cartridge 25, a pressing roller 32 that is opposed to the heat roller 31, and a transport roller 33 that is disposed downstream of the rollers 31 and 32.

The heat roller 31 is made of a metal and incorporates a halogen lamp for heating. With this structure, the toner that has been transferred to the sheet 3 in the process cartridge 25 can be thermally fixed as the sheet 3 passes between the heat roller 31 and the pressing roller 32. Then, the sheet 3 is transported by the transport roller 33 of the fixing section 26 to sheet ejection rollers 35 that are provided on the main body 2. Then, the sheet 3 is ejected onto a sheet ejection tray 36 through a sheet outlet 40 by the sheet ejection rollers 35.

In the laser printer 1, a re-transport unit (auxiliary slide unit) 41 to be used for forming images on both surfaces of a sheet 3 is attached to (inserted in) the main body 2 in a detachable manner so as to occupy a space above the sheet feeding cassette 6. A re-transport path 42 for sending a sheet 3 to the image forming section 5 at the time of double-sided printing is formed in a top-rear portion of the main body 2 and the re-transport unit 41.

In the laser printer 1 having the above configuration, double-sided printing is performed in the following manner. A sheet 3 is caused to pass through the image forming section 5 and the sheet 3 bearing an image on the front surface is transported to the sheet ejection rollers 35. Then, the sheet ejection rollers 35 holding the sheet 3 between them are rotated reversely, whereby the sheet 3 is sent to the image forming section 5 via the re-transport path 42. An image is formed again on the back surface. The re-transport unit 41 can be pulled out of the apparatus by sliding it to the rear side, which facilitates jam recovery work to be done when a jam of a sheet 3 has occurred in the re-transport path 42.

As shown in FIG. 3 (front sectional view), the main body 2 of the laser printer 1 has sheet metal frames 63R and 63L on the right side and the left side of the apparatus, respectively. Outer covers 61T, 61R, and 61L made of a synthetic resin are attached to the frames 63R and 63L (see FIGS. 1 and 3).

As shown in FIG. 1, the outer covers 61T, 61R, and 61L cover the top portion, right portion, and left portion of the apparatus, respectively. The top cover 61T is formed with the sheet ejection tray 36 and the sheet outlet 40 through which to eject a sheet 3. As shown in FIG. 3, the sheet feeding cassette 6 is mounted inside the main body 2 by causing it to slide so as to be inserted between the right and left frames 63R and 63L.

As shown in FIGS. 1 and 3, the bottom edge of the left cover 61L that extends in the front-rear direction is formed with a recess 62 at the center. Likewise, as shown in FIG. 3, the right cover 61R is formed with a recess. A user can carry the laser printer 1 easily by hooking his or her fingers on the recesses 62.

As shown in FIGS. 3 and 4, an elevating plate driving unit 68 is attached to a front portion of the inner surface of the right frame 63R of the sheet metal frames 63R and 63L. As schematically shown in FIG. 4, the elevating plate driving unit 68 is composed of an electric motor 70, an output gear 73, and a gear train for connecting the electric motor 70 and the output gear 73.

The elevating plate driving unit 68 is covered with a driving unit cover 69 made of a synthetic resin. The electric motor 70, the output gear 73, the gear train, etc., that constitute the elevating plate driving unit 68 are supported by or fixed to the driving unit cover 69. Part of the output gear 73 is exposed from the front surface of the driving unit cover 69 so as to mesh with an input gear 74 (described later) of the sheet feed cassette 6.

Next, the sheet feed cassette 6 will be described in detail.

Figure 5:
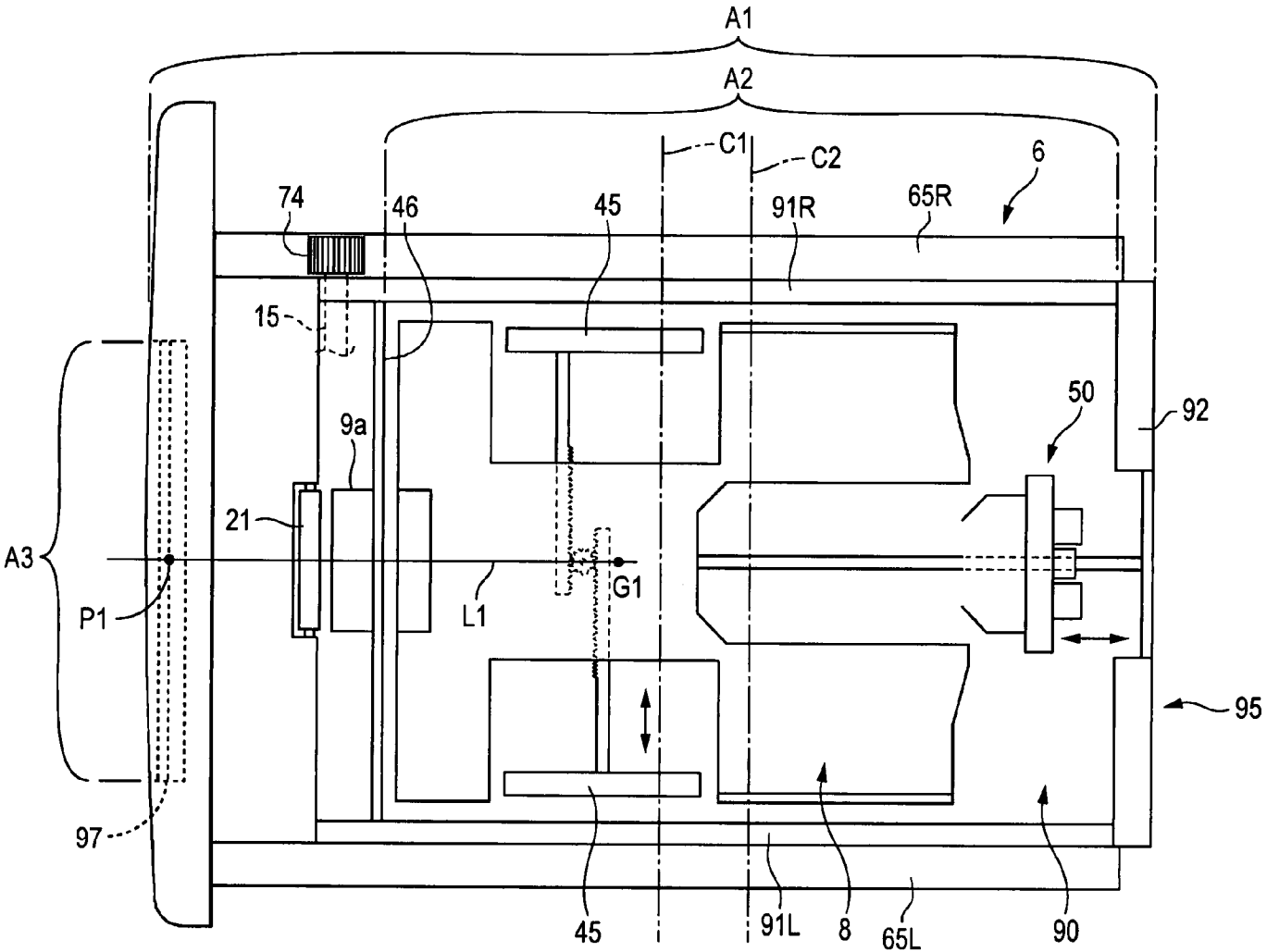
FIG. 5 is a plan view of a sheet feeding cassette.
Figure 6:
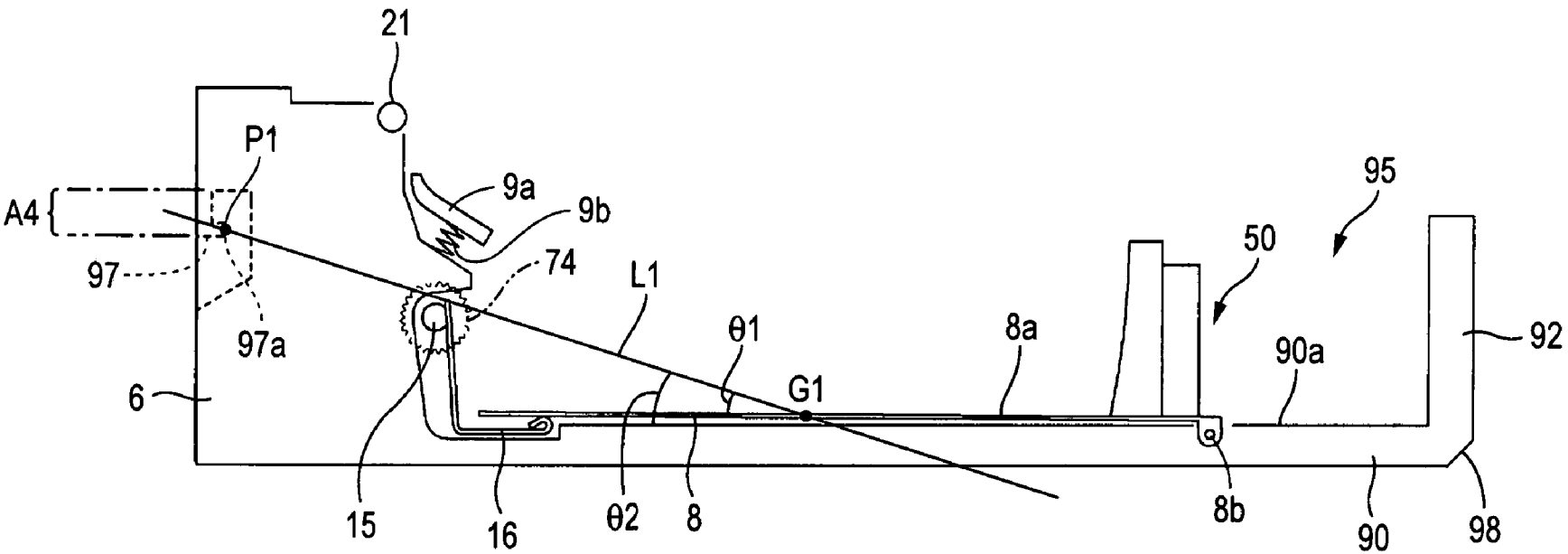
FIG. 6 is a schematic side sectional view of the sheet feeding cassette.

FIGS. 5 and 6 are a plan view and a side sectional view, respectively, of the sheet feed cassette 6 in a state that it is removed from the main body 2. As shown in FIGS. 5 and 6, the sheet feeding cassette 6 is configured so as to be able to be attached to and removed from the image forming apparatus main body 2 that is equipped with the image forming section 5. And the sheet feeding cassette 6 has a box-shaped accommodation portion 95 capable of accommodating a plurality of sheets. The accommodation portion 95 has a bottom plate 90, a right wall 91R and a left wall 91L that are erected vertically from the right and left ends of the floor plate 90, a rear wall 92 that is erected vertically from the rear end of the floor plate 90, and a reference wall 46 (described later) and thereby assumes a box shape. As such, the sheet feeding cassette 6 can accommodate stacked sheets (see FIG. 6 etc.). The above-mentioned sheet elevating plate 8 is provided in the accommodation portion 95, more specifically, on the floor plate 90, so as to be able to rotate about a horizontal shaft 8*b*. Having such a structure, the sheet elevating plate 8 can move the sheets in the vertical direction.

As shown in FIG. 5, the sheet feeding cassette 6 is equipped, in the accommodation portion 95, with direction restricting guides 45 for guiding both side edges of the sheets 3 stacked on the sheet elevating plate 8 and a rear guide 50 for guiding the rear ends of the sheets 3. To deal with sheets 3 having various sizes, the guides 45 and 50 can reciprocate to change their positions. The reference wall 46 against which the front ends of the sheets 3 are to bump is disposed in front of the sheet elevating plate 8 so as to serve as part of the accommodation portion 95. The sheets 3 are set (stacked) in place on the sheet elevating plate 8 in such a manner that their front ends, rear ends, and side ends are applied to the reference wall 46, the rear guide 50, and the direction restricting guides 45, respectively.

Next, important features of this embodiment will be described. In this embodiment, a grip 97 to be used for holding the sheet feeding cassette 6 with a hand is provided close to the front surface of the sheet feeding cassette 6 so as to be located above a sheet placement surface on which sheets 3 are to be placed in the accommodation portion 95, and the angle formed by the sheet placement surface and a straight line L1 passing through the grip 97 and the center of gravity G1 of the sheet feeding cassette 6 is larger than or equal to 5°. The sheet feeding cassette 6 according to this embodiment is long in the front-rear direction and the grip 97 is provided in a front end portion in the longitudinal direction. In this example, the surface of the sheet elevating plate 8 is part of the sheet placement surface and the angle θ1 formed by the surface 8*a* of the sheet elevating plate 8 and the straight line L1 is larger than or equal to 5°. On the rear side of the accommodation portion 95, the surface 90*a* of the bottom plate 90 (i.e., the bottom surface of the accommodation portion 95) is also part of the sheet placement surface and the angle θ2 formed by the surface 90*a* of the bottom plate 90 and the straight line L1 is larger than or equal to 5°.

Figure 8:
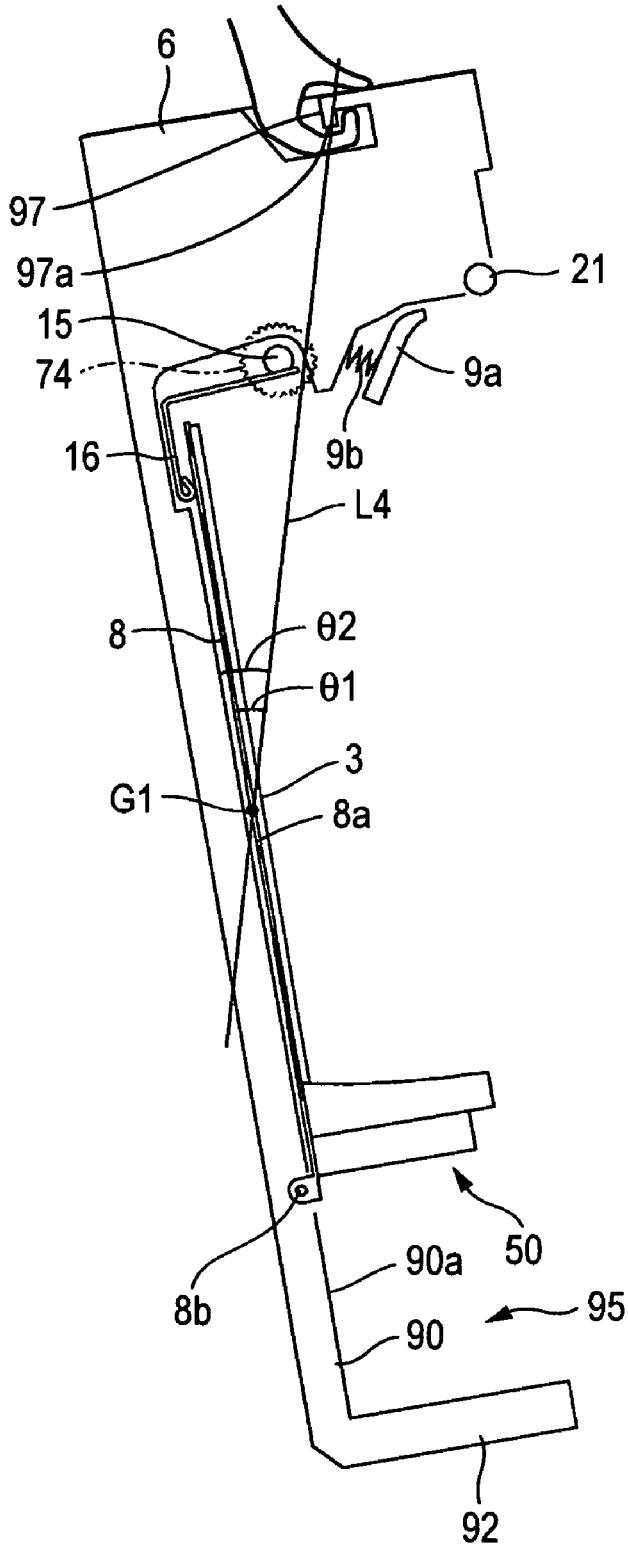
FIG. 8 illustrates a posture of the sheet feeding cassette that is hung after removal.

In the above-configured sheet feeding cassette 6 according to this embodiment, as shown in FIG. 8, when the sheet feeding cassette 6 is hung by holding the grip 97 with a hand, the sheet feeding cassette 6 is inclined in such a manner that a vertical line L4 passing through the grip 97 crosses the sheet placement surface of the sheet feeding cassette 6 and the angle formed by the vertical line L4 and the surfaces 8*a* and 90*a* that constitute the sheet placement surface is larger than or equal to 5°. Therefore, even if the sheet feeding cassette 6 is hung by holding only the grip 97 with one hand, the sheets 3 are inclined and hence are not prone to fall. The grip 97 is provided with a recess 97*b* into which to insert fingers. And a rearward projection 97*a* for preventing a slip of fingers is formed in the recess 97*b* so as to project rearward.

Figure 7:
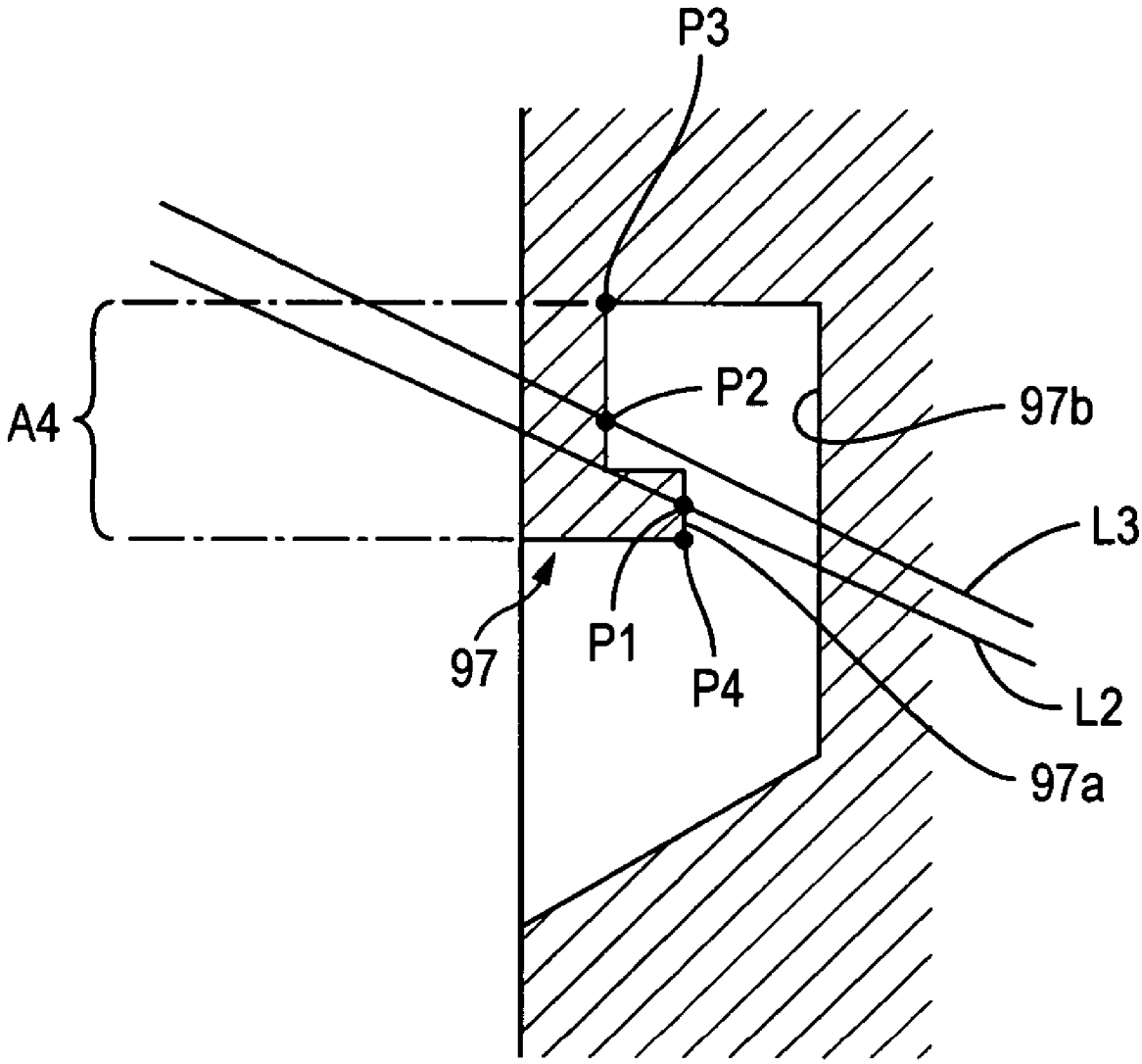
FIG. 7 is an enlarged view illustrating a grip.

The expression "the straight line passing through the grip and the center of gravity of the sheet feeding cassette" will be described more specifically. The desired effect can be obtained as long as a straight line passing through the center of gravity G1 and one position (in FIG. 7, one position from position P3 to position P4) in a region of the grip 97 that can be supported by fingers (in this embodiment, such straight lines are generically called "straight line L1") is inclined from the sheet placement surface by 5° or more. In the case of the structure having the rearward projection 97*a* (see FIG. 7), it is desirable that a straight line L2 passing through a peak position P1 of the rearward projection 97*a* and the center of gravity G1 be inclined from the sheet placement surface by 5° or more.

Where the rearward projection 97*a* is not provided, a straight line L3 passing through the center of gravity G1 and the center position P2 of a region where the grip 97 is provided be inclined from the sheet placement surface by 5° or more. Stated in more detail, it is even preferable that a straight line passing through the center of gravity G1 and any position (in the example of FIG. 7, any position from position P3 to position P4) on a surface that can be supported by fingers (in FIG. 7, the rear surfaces in a region A4 where the grip 97 is provided) be inclined from the sheet placement surface by 5° or more.

The sheet feeding cassette 6 is configured in the following manner so that its center of gravity G1 is located at the above-described position. First, referring to FIGS. 5 and 6, as described above, whereas the accommodation portion 95 is made of a resin material (synthetic resin), the direction restricting guides 45 for restricting the position of sheets in the width direction is made of a material (e.g., metal material) that is higher in density than the material (resin material) of the accommodation portion 95 and are disposed closer to the front surface of the sheet feeding cassette 6 in an inside region A2 of the accommodation portion 95. More specifically, the direction restricting guides 45 are disposed closer to the front surface of the sheet feeding cassette 6 in the accommodation portion 95 so that the centers of gravity of the direction restricting guides 45 are located on the front side of the center position C2 of the accommodation portion 95. In this example, the direction restricting guides 45 are disposed in such a manner that their centers are located on the front side of the center C1 of the entire sheet feeding cassette 6. In FIG. 5, the entire region of the sheet feeding cassette 6 in the front-rear direction is denoted by symbol A1 and symbol C1 denotes its center position.

Likewise, the sheet elevating plate 8 is made of a material (e.g., metal material) that is higher in density than the material (resin material) of the accommodation portion 95 and is disposed closer to the front surface of the sheet feeding cassette 6 in the accommodation portion 95. The sheet elevating plate 8 is disposed in such a manner that its center of gravity is located on the front side of the center C2 of the accommodation portion 95. Moreover, the sheet elevating plate 8 may be disposed in such a manner that its center of gravity is located on the front side of the center C1 of the entire sheet feeding cassette 6. Further, a mechanism for moving the sheet elevating plate 8 in the vertical direction is also disposed closer to the front surface of the sheet feeding cassette 6.

Figure 10:
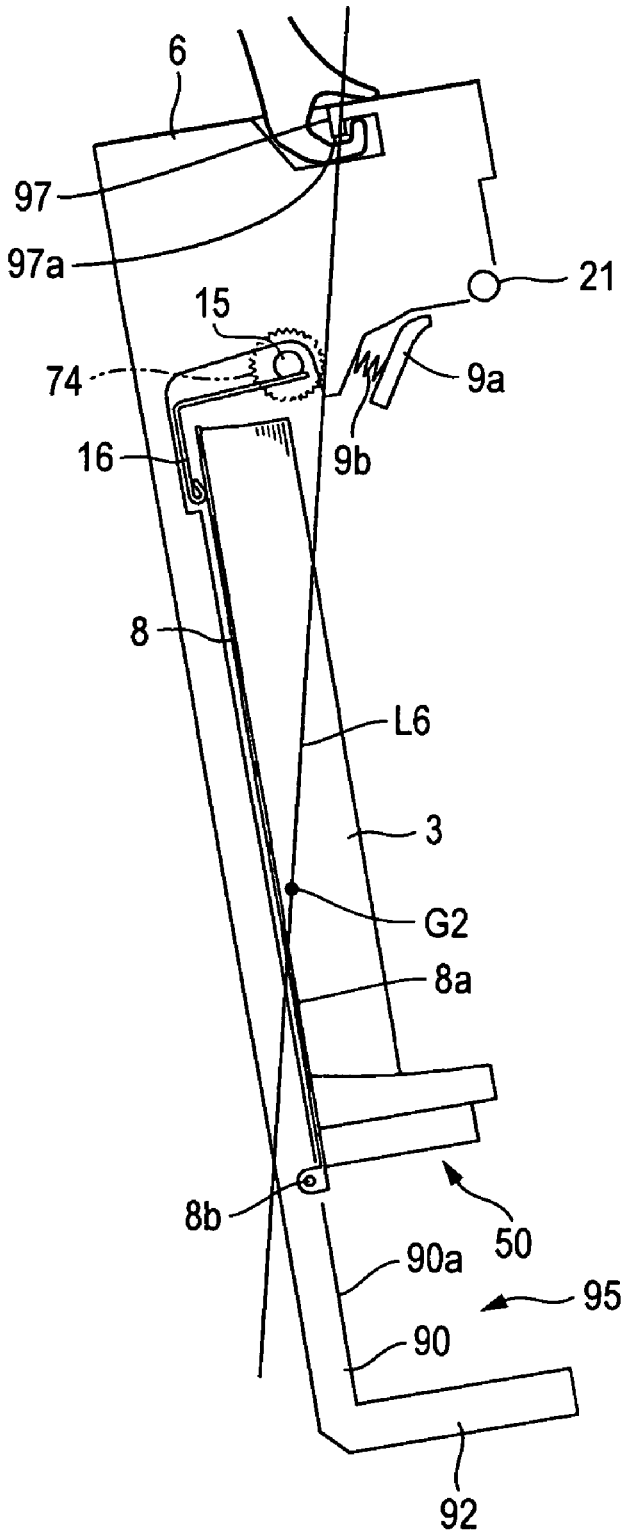
FIG. 10 illustrates a posture of the sheet feeding cassette that is hung after removal, with the accommodation portion filled with a maximum number of sheets.

In this example, as shown in FIG. 5, the rotary shaft 15 penetrates through the right wall 91R and projects rightward and the input gear 74 is fixed to the projection end of the rotary shaft 15. The rotary shaft 15, the press-operating member 16, and the input gear 74 functions as the "mechanism that moves the sheet elevating plate in the vertical direction" and all of the rotary shaft 15, the press-operating member 16, and the input gear 74 are disposed on the front side of the center C1 of the sheet feeding cassette 6. When the sheet feeding cassette 6 is pushed into the main body and set therein, the input gear 74 is brought into engagement with the output gear 73 of the elevating plate driving unit 68 (see FIG. 4). That is, when the sheet feeding cassette 6 is removed from the main body 2, the input gear 74 is disengaged from the output gear 73 and hence the force for pushing up the sheet elevating plate 8 no longer acts on the rotary shaft 15 and the press-operating member 16. Therefore, as soon as the sheet feeding cassette 6 is removed from the main body 2, the sheet elevating plate 8 moves downward to take the posture of FIG. 6. With the above structure, when the sheet feeding cassette 6 is removed from the image forming apparatus main body 2, all the sheets 3 move toward the bottom plate 90 as the sheet elevating plate 8 moves downward, which enhances the fall preventing effect. More specifically, the sheet elevating plate 8 is rotatable about the shaft 8*b*. In a state that the sheet feeding cassette 6 is set in the main body 2, the sheet elevating plate 8 is inclined in such a manner that its front side (i.e., the side of the grip 97) is higher as shown in FIG. 2. On the other hand, when the sheet feeding cassette 6 is removed from the main body 2, as shown in FIG. 6 the sheet elevating plate 8 rotates about the shaft 8*b* and the front side of the sheet elevating plate 8 that has been located high moves downward (toward the bottom) to establish a state that the entire sheet elevating plate 8 is set low in the depth direction of the accommodation portion 95. In this embodiment, in a state that the sheet feeding cassette 6 is set in the main body 2, as shown in FIG. 2 the surface 8*a* of the sheet elevating plate 8 is inclined from the surface 90*a* of the bottom plate 90. On the other hand, when the sheet feeding cassette 6 is removed from the main body 2, almost no angle is formed between the surface 8*a* of the sheet elevating plate 8 and the surface 90*a* of the bottom plate 90 (i.e., the surfaces 8*a* and 90*a* are parallel or generally parallel with each other). Therefore, when the sheet feeding cassette 6 is removed from the main body 2 and held with a hand, as shown in FIGS. 8 and 10 the sheets 3 are set at a deeper position in the accommodation portion 95 and the front side (i.e., grip 97 side) of the sheets 3 is not very high (in the depth direction of the accommodation portion 95): the sheets 3 are not prone to fall.

Further, the sheet powder removing mechanism (sheet powder removing roller 21) for removing sheet powder that is stuck to a sheet 3 in feeding it and the sheet separating mechanism (separating pad 9*a*) for separating a sheet 3 in feeding it are disposed on the front side of the sheet feeding cassette 6. Since the major components of the sheet feeding cassette 6 are disposed on its front side as described above and the grip 97 is provided at the high position, the center of gravity of the sheet feeding cassette 6 is set in the above-described manner and the sheet feeding cassette 6 is inclined properly when removed.

In this embodiment, as shown in FIG. 5, the center of gravity G1 of the sheet feeding cassette 6 and the center of the grip 97 (i.e., the center of a grip forming region A3 in the width direction) are located approximately at the centers in the sheet width direction in a state that sheets 3 are accommodated in the accommodation portion 95. In the example of FIG. 5, one projected side portion (projects in the width direction (upward in FIG. 5)) of the front portion of the sheet feeding cassette 6 is longer than the other projected side portion. The portion of the sheet feeding cassette 6 on the same side as the shorter projected side portion may be made somewhat heavier so that the center of gravity G1 is located approximately at the center in the sheet width direction even in the case where the sheet feeding cassette 6 has such a shape.

As described above, the sheet feeding cassette 6 can be inserted in the main body 2 and the grip 97 is provided on the side of the sheet feeding cassette 6 that is opposite to the side that is inserted first into the main body 2. The sheet feeding cassette 6 has a chamfered portion 98 at the bottom of the end portion that is inserted first, which increases the ease of insertion.

Figure 9:
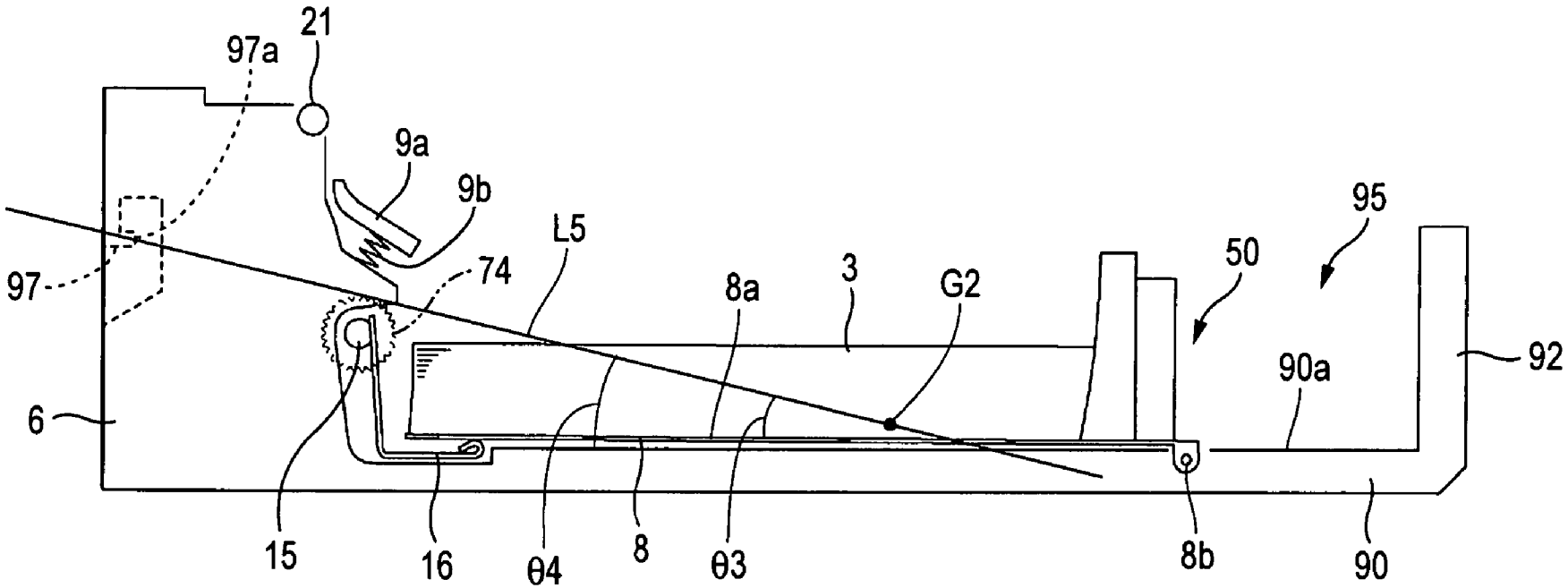
FIG. 9 is a schematic side sectional view showing a state that a maximum number of sheets are set in an accommodation portion.

Further, in the sheet feeding cassette 6 according to the embodiment, as shown in FIG. 9, in a state that a maximum accommodable number of sheets 3 are accommodated in the accommodation portion 95, both angles θ3 and θ4 formed by the sheet placement surface (surfaces 8*a* and 90*a*) and a straight line L5 passing through the grip 97 and the center of gravity G2 of a composite body consisting of the sheet feeding cassette 6 and the sheets 3 are larger than or equal to 5°. In this embodiment, in a state that a maximum number of sheets 3 are accommodated in the accommodation portion 95, the grip 97 is located above the top surface of the stacked sheets 3. Even in this case, as shown in FIG. 10, when the composite body consisting of the sheet feeding cassette 6 and the maximum number of sheets 3 is hung by holding the grip 97 with a hand, the composite body is inclined in such a manner that a vertical line L6 passing through the grip 97 crosses the sheet placement surface of the sheet feeding cassette 6 and the angles formed by the vertical line L6 and the sheet placement surface (surfaces 8*a* and 90*a*) become larger than or equal to 5°.

Figure 11:
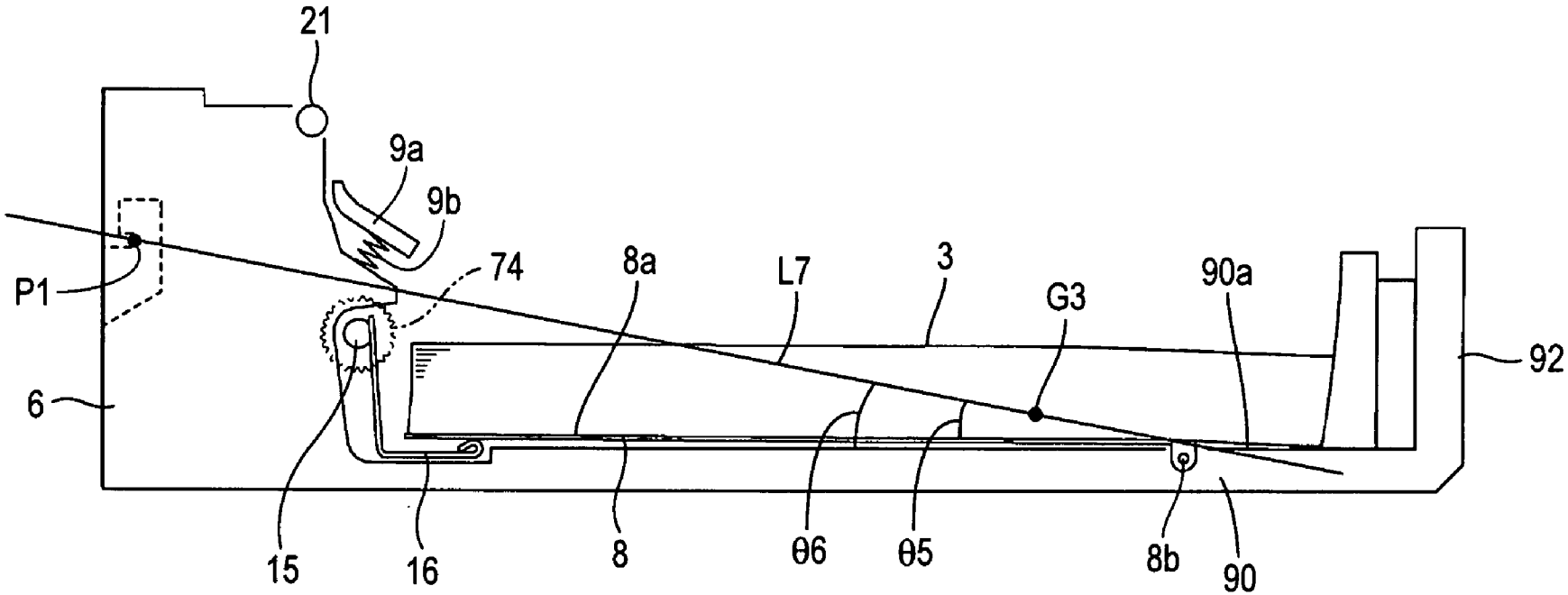
FIG. 11 is a schematic side sectional view showing a state that a maximum number of sheets having a maximum size are set in the accommodation portion.

The accommodation portion 95 of the sheet feeding cassette 6 according to the embodiment is configured so as to be able to accommodate sheets 3 of plural sizes. As shown in FIG. 11, even where a maximum number of sheets 3 having the maximum size among the accommodable sizes are accommodated, both angles θ5 and θ6 formed by a straight line L7 passing through the grip 97 and the center of gravity G3 of the composite body and the sheet placement surface (surfaces 8*a* and 90*a*) are larger than or equal to 5°. Even in this case, although not shown in any drawing, when the composite body consisting of the sheet feeding cassette 6 and the maximum number of sheets 3 is hung by holding the grip 97 with a hand, the composite body is inclined in such a manner that a vertical line passing through the grip 97 crosses the sheet placement surface of the sheet feeding cassette 6 and the angles formed by the vertical line and the sheet placement surface (surfaces 8*a* and 90*a*) become larger than or equal to 5°.

In this embodiment, in a state that a maximum accommodable number of sheets are accommodated in the accommodation portion 95, an angle formed by the sheet placement surface and a straight line passing through the grip and a center of gravity of a composite body consisting of the sheet feeding cassette and the sheets is larger than or equal to 5°.

Therefore, even in the case where a maximum number of sheets are accommodated, the sheet feeding cassette is inclined to such an extent that the sheets are not prone to fall when the sheet feeding cassette is hung by holding the grip.

Further, the accommodation portion 95 is configured so as to be able to accommodate sheets of a plurality of sizes, and in a state that a maximum number of sheets having a maximum size among the accommodable sizes are accommodated in the accommodation portion, an angle formed by the sheet placement surface and a straight line passing through the grip and the center of gravity of the composite body is larger than or equal to 5°.

Therefore, even in the case where a maximum number of sheets having a maximum size are accommodated, the sheet feeding cassette is inclined to such an extent that the sheets are not prone to fall when the sheet feeding cassette is hung by holding the grip.

Moreover, whereas the accommodation portion 95 is made of a resin material, a direction restricting guide 45 for restricting a position of the sheets in its width direction is made of a material that is higher in density than the resin material and is disposed closer to a front surface of the sheet feeding cassette. The term "density" as used in this specification means the density that is used in physics, that is, the mass of a substance per unit volume.

Therefore, the center of gravity can be set closer to the front surface by the simple measure of adjusting the materials and the positions of the accommodation portion and the direction restricting guide. This configuration also reduces the number of components and contributes to space saving.

Further, at least part of the sheet placement surface is formed by a sheet elevating plate 8 capable of moving in a vertical direction for moving the sheets in the vertical direction, and the sheet elevating plate is made of a material that is higher in density than the resin material and is disposed closer to the front surface of the sheet feeding cassette. Moreover, the sheet elevating plate 8 has a mechanism for causing the sheet elevating plate to move to a low position when the sheet feeding cassette is removed from the image forming apparatus main body. Furthermore, a mechanism for moving the sheet elevating plate 8 in the vertical direction is disposed closer to the front surface of the sheet feeding cassette.

Therefore, the center of gravity can be set closer to the front surface by the simple measure of forming the sheet elevating plate with a high-density material and disposing it closer to the front surface of the sheet feeding cassette. This configuration also reduces the number of components and contributes to space saving. Since the shape of the sheet elevating plate can be adjusted easily, the position of the center of gravity can be adjusted easily.

Also, the sheet elevating plate 8 can be moved to the low position when the sheet feeding cassette is removed from the image forming apparatus main body. Therefore, falling of sheets can be prevented more reliably.

According to this configuration, not only the sheet elevating plate 8 but also the moving mechanism is located on the side of the front surface. As such, this is a preferable configuration in which the center of gravity can be set even closer to the front surface while the sheet elevating plate can be moved.

In this embodiment, a sheet powder removing mechanism for removing sheet powder that is stuck to a sheet is disposed on the side of the front surface of the sheet feeding cassette. Further, a separating mechanism for separating a sheet in feeding it is disposed on the side of the front surface of the sheet feeding cassette.

Therefore, the sheet powder removing mechanism removes sheet powder that is stuck to a sheet. This makes it possible to set the center of gravity closer to the front surface by the simple measure without the need for newly using a special center-of-gravity adjusting component. This configuration also reduces the number of components and contributes to space saving.

Further, the separating mechanism for separating a sheet in feeding it is disposed on the side of the front surface of the sheet feeding cassette and the separating mechanism serves to set the center of gravity closer to the front surface. This makes it possible to set the center of gravity closer to the front surface while realizing a structure that enables sheet separation and feeding, by the simple measure without the need for newly using a special center-of-gravity adjusting component. This configuration also reduces the number of components and contributes to space saving.

In this embodiment, the center of gravity of the sheet feeding cassette and a center of the grip are located approximately at centers in the width direction of the sheets that are accommodated in the accommodation portion.

Therefore, the composite body is balanced well in the width direction and is not prone to incline in the width direction when held with a hand.

In this embodiment, the grip 97 has a recess in which to insert fingers, and a rearward projection for preventing a slip of fingers is formed in the recess.

With this structure of the grip, the fingers holding the grip are less prone to slip in attaching or removing the sheet feeding cassette. In particular, when it is attempted to hang the sheet feeding cassette by holding only the grip, not only is falling of sheets prevented as described above but also a slip of fingers is prevented. As such, this configuration is more advantageous in hanging the sheet feeding cassette.

In this embodiment, the sheet feeding cassette 6 is configured so as to be able to be inserted in the image forming apparatus main body, and that the grip is provided on a side of the sheet feeding cassette that is opposite to a side that is inserted first into the image forming apparatus main body and a chamfered portion, a curved portion, or a rolling member capable of rolling is formed or provided at a bottom of an end portion that is inserted first.

According to this configuration, the sheet feeding cassette can easily be inserted into the image forming apparatus main body. Usually, the sheet feeding cassette is inserted into the main body by holding it with both hands because it is difficult to insert the sheet feeding cassette by holding only the grip. In contrast, the sheet feeding cassette having this configuration can easily be inserted even by holding only the grip and hence is easier to handle.

In the image forming apparatus 1 having this configuration, sheets are not prone to fall in attaching or removing the sheet feeding cassette and hence the sheet feeding cassette is easy to handle.

The embodiment of the invention has been described above. However, the technical scope of the invention is not limited to the embodiment and the invention can be practiced in the following modified forms, for example.

(1) In the above embodiment, the position of the center of gravity is adjusted by providing the major components (sheet elevating plate 8, direction restricting guides 45, separating mechanism, sheet powder removing mechanism, etc.) of the sheet feeding cassette 6 closer to its front surface. Alternatively, a center-of-gravity adjustment weight (e.g., metal member) may be provided additionally and disposed closer to the front surface of the sheet feeding cassette 6 in addition to or irrespective of the adjustment using the major components.

(2) Although the above embodiment is a preferable example in which the grip 97 is provided at one end of the sheet feeding cassette 6 in the longitudinal direction, the grip may be provided at one end of the sheet feeding cassette in the shorter-axis direction.

(3) Although in the above embodiment the chamfered portion 98 is formed at the rear bottom edge of the sheet feeding cassette 6 to increase the ease of insertion, the same effect may be attained by forming or disposing, at the same position, a curved portion, a rolling member(s) (e.g., roller(s)) capable of rolling, or the like.

Figure 12:
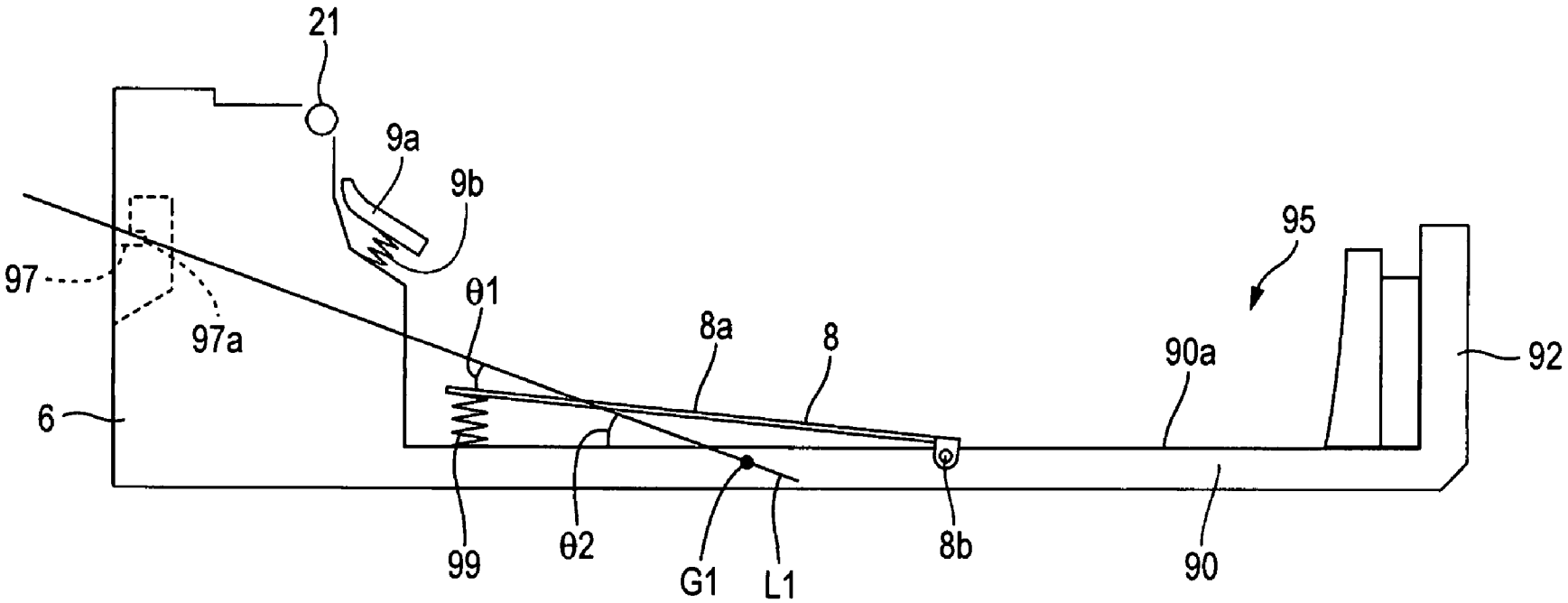
FIG. 12 is a schematic side sectional view showing a modification of the sheet feeding cassette of FIG. 6.

(4) In the above embodiment, in the case where the sheet placement surface consists of a plurality of surfaces (e.g., sheets 3 are placed on a plurality of surfaces that form a bent surface), the intended effect is obtained as long as the angle formed by the straight line (L1, L5, or L7) and at least one of those surfaces (in the example of FIG. 6, the surfaces 8*a* and 90*a*) is larger than or equal to 5° (the angle formed by the straight line and any of those surfaces should be larger than or equal to 0°) and it is desirable that the angle formed by the straight line (L1, L5, or L7) and any of those surfaces be larger than or equal to 5°. However, the plurality of surfaces may form a bent surface. FIG. 12 shows such an example in which the surface 8*a* of the sheet elevating plate 8 and the surface 90*a* of the bottom plate 90 form a bent surface. The angles θ1 and θ2 formed by the surfaces 8*a* and 90*a* and the straight line L1 are set larger than or equal to 0° and larger than or equal to 5°, respectively. This concept also applies to the cases of the straight line L5 (FIG. 9) and the straight line L7 (FIG. 11). Although in the example of FIG. 12 the sheet elevating plate 8 is elevated and lowered by means of a spring member 99, this concept may be implemented by using a mechanism that elevates and lowers the sheet elevating plate 8 by means of a motor and gears as in the case of the above embodiment.

(5) Although in the above embodiment the invention is applied to the image forming apparatus having the single sheet feeding cassette 6, a plurality of sheet feeding cassettes 6 may be provided. Although in the above embodiment the sheet feeding cassette 6 slides parallel with the sheet feeding direction, the invention can also be applied to a case that the sheet feeding cassette 6 slides perpendicularly to the sheet feeding direction.

(6) Although in the above embodiment the feed roller 9 and the pickup roller 10 of the separating and feeding section 7 are provided in the main body 2, the invention can also be applied to a case that the rollers 9 and 10 are provided in the sheet feeding cassette 6. The invention is not limited to the case that the separating and feeding section 7 is formed by the feed roller 9 and the pickup roller 10 and can similarly be applied to a case that a sheet is picked up and fed by a single roller.

(7) In the above embodiment the angles formed by the sheet placement surface (surfaces 8*a* and 90*a*) and the straight line (L1, L5, or L7) are set larger than or equal to 5°. Although is no particular limit on the upper limit, it is advantageous in terms of designing if the angles are set smaller than or equal to 15°.

(8) Although in the above embodiment the sheet elevating plate 8 lowers automatically upon removal of the sheet feeding cassette 6, another configuration is possible in which the sheet elevating plate 8 is lowered by a manipulation of a user.

What is claimed is:

1. A sheet feeding cassette comprising:

a box-shaped accommodation portion capable of accommodating a sheet, the accommodation portion having a sheet placement surface on which the sheet is to be placed; and a grip to be used for holding the sheet feeding cassette with a hand, the grip being provided to a front surface side of the sheet feeding cassette so as to be located above the sheet placement surface;

wherein an angle formed by the sheet placement surface and a straight line passing through the grip and a center of gravity of the sheet feeding cassette is larger than or equal to 5°.

2. The sheet feeding cassette according to claim 1, wherein in a state that a maximum accommodable number of sheets are accommodated in the accommodation portion, an angle formed by the sheet placement surface and a straight line passing through the grip and a center of gravity of a composite body consisting of the sheet feeding cassette and the sheets is larger than or equal to 5°.

3. The sheet feeding cassette according to claim 2, wherein the accommodation portion is configured so as to be able to accommodate sheets of a plurality of sizes, and in a state that a maximum number of sheets having a maximum size among the accommodable sizes are accommodated in the accommodation portion, an angle formed by the sheet placement surface and a straight line passing through the grip and the center of gravity of the composite body is larger than or equal to 5°.

4. The sheet feeding cassette according to claim 1, further comprising a direction restricting guide that restricts a position of the sheet in a width direction of the sheet;

wherein the accommodation portion is made of a resin material, whereas the direction restricting guide is made of a material that is higher in density than the resin material and is disposed on the front surface side of the sheet feeding cassette.

5. The sheet feeding cassette according to claim 1, further comprising a sheet elevating plate capable of moving in a vertical direction for moving the sheet in the vertical direction, the sheet elevating plate forming at least part of the sheet placement surface;

wherein the accommodation portion is made of a resin material, whereas the sheet elevating plate is made of a material that is higher in density than the resin material and is disposed on the front surface side of the sheet feeding cassette.

6. The sheet feeding cassette according to claim 5, wherein the sheet elevating plate has a mechanism for causing the sheet elevating plate to move to a low position when the sheet feeding cassette is removed from an image forming apparatus main body that has an image forming section.

7. The sheet feeding cassette according to claim 5, wherein a mechanism that moves the sheet elevating plate in the vertical direction is disposed on the front surface side of the sheet feeding cassette.

8. The sheet feeding cassette according to claim 1, wherein a sheet powder removing mechanism that removes sheet powder that is stuck to a sheet is disposed on the front surface side of the sheet feeding cassette.

9. The sheet feeding cassette according to claim 1, wherein a separating mechanism that separates a sheet in feeding the sheet is disposed on the front surface side of the sheet feeding cassette.

10. The sheet feeding cassette according to claim 1, wherein the center of gravity of the sheet feeding cassette and a center of the grip are located approximately at a center in a width direction of the sheet that is accommodated in the accommodation portion.

11. The sheet feeding cassette according to claim 1, wherein the grip has a recess for inserting fingers, and a rearward projection for preventing a slip of fingers is formed in the recess.

12. The sheet feeding cassette according to claim 1, wherein the sheet feeding cassette is configured so as to be able to be inserted in an image forming apparatus main body that has an image forming section;

the grip is provided on a first side of the sheet feeding cassette that is opposite to a second side of the sheet feeding cassette that is inserted first into the image forming apparatus main body; and a chamfered portion, a curved portion, or a rolling member capable of rolling is provided at a bottom of an end portion of the second side.

13. An image forming apparatus comprising:

an image forming section; and a sheet feeding cassette including: a box-shaped accommodation portion capable of accommodating a sheet, the accommodation portion having a sheet placement surface on which the sheet is to be placed; and a grip to be used for holding the sheet feeding cassette with a hand, the grip being provided to a front surface side of the sheet feeding cassette so as to be located above the sheet placement surface;

wherein an angle formed by the sheet placement surface and a straight line passing through the grip and a center of gravity of the sheet feeding cassette is larger than or equal to 5°.

* * * * *